US009304423B2

(12) United States Patent
Iwazaki et al.

(10) Patent No.: US 9,304,423 B2
(45) Date of Patent: Apr. 5, 2016

(54) ELECTROSTATIC CHARGE IMAGE DEVELOPING TONER, ELECTROSTATIC CHARGE IMAGE DEVELOPER, TONER CARTRIDGE, AND PROCESS CARTRIDGE

(71) Applicant: FUJI XEROX CO., LTD., Tokyo (JP)

(72) Inventors: Eisuke Iwazaki, Kanagawa (JP); Narumasa Sato, Kanagawa (JP); Asafumi Fujita, Kanagawa (JP); Kotaro Yoshihara, Kanagawa (JP); Noriyuki Mizutani, Kanagawa (JP); Tomoaki Tanaka, Kanagawa (JP)

(73) Assignee: FUJI XEROX CO., LTD., Tokyo (JP)

( * ) Notice: Subject to any disclaimer, the term of this patent is extended or adjusted under 35 U.S.C. 154(b) by 0 days.

(21) Appl. No.: 14/456,482

(22) Filed: Aug. 11, 2014

(65) Prior Publication Data

US 2015/0268573 A1 Sep. 24, 2015

(30) Foreign Application Priority Data

Mar. 18, 2014 (JP) ..... 2014-055489

(51) Int. Cl.
*G03G 9/08* (2006.01)
*G03G 9/087* (2006.01)

(52) U.S. Cl.
CPC ..... *G03G 9/08711* (2013.01); *G03G 9/08728* (2013.01); *G03G 9/08755* (2013.01)

(58) Field of Classification Search
CPC ..... G03G 9/08711; G03G 9/08755
USPC ..... 430/109.3, 109.4
See application file for complete search history.

(56) References Cited

U.S. PATENT DOCUMENTS

| | | | | |
|---|---|---|---|---|
| 8,367,294 | B2 * | 2/2013 | Nosella et al. | 430/137.14 |
| 2006/0292475 | A1 * | 12/2006 | Veregin et al. | 430/109.3 |
| 2011/0305984 | A1 | 12/2011 | Tominaga et al. | |
| 2013/0149642 | A1 | 6/2013 | Sabu et al. | |
| 2013/0252161 | A1 * | 9/2013 | Kawakami et al. | 430/108.3 |

FOREIGN PATENT DOCUMENTS

| | | |
|---|---|---|
| JP | A-2012-18391 | 1/2012 |
| JP | A-2013-140333 | 7/2013 |

* cited by examiner

*Primary Examiner* — Mark A Chapman
(74) *Attorney, Agent, or Firm* — Oliff PLC

(57) ABSTRACT

An electrostatic charge image developing toner includes toner particles containing an amorphous polyester resin (a1), a crystalline polyester resin (a2), and a styrene-acrylic resin (b) containing 2-carboxyethyl acrylate as a polymerization component.

9 Claims, 2 Drawing Sheets

ELECTROSTATIC CHARGE IMAGE DEVELOPING TONER, ELECTROSTATIC CHARGE IMAGE DEVELOPER, TONER CARTRIDGE, AND PROCESS CARTRIDGE

CROSS-REFERENCE TO RELATED APPLICATIONS

This application is based on and claims priority under 35 USC 119 from Japanese Patent Application No. 2014-055489 filed Mar. 18, 2014.

BACKGROUND

1. Technical Field

The present invention relates to electrostatic charge image developing toner, an electrostatic charge image developer, a toner cartridge, and a process cartridge.

2. Related Art

Various toner items have been proposed as the electrostatic charge image developing toner to be applied to an electrophotographic image forming apparatus.

SUMMARY

According to an aspect of the invention, there is provided an electrostatic charge image developing toner including:

toner particles containing an amorphous polyester resin (a1), a crystalline polyester resin (a2), and a styrene-acrylic resin (b) containing 2-carboxyethyl acrylate as a polymerization component.

BRIEF DESCRIPTION OF THE DRAWINGS

Exemplary embodiments of the present invention will be described in detail based on the following figures, wherein.

DETAILED DESCRIPTION

Figure 1:
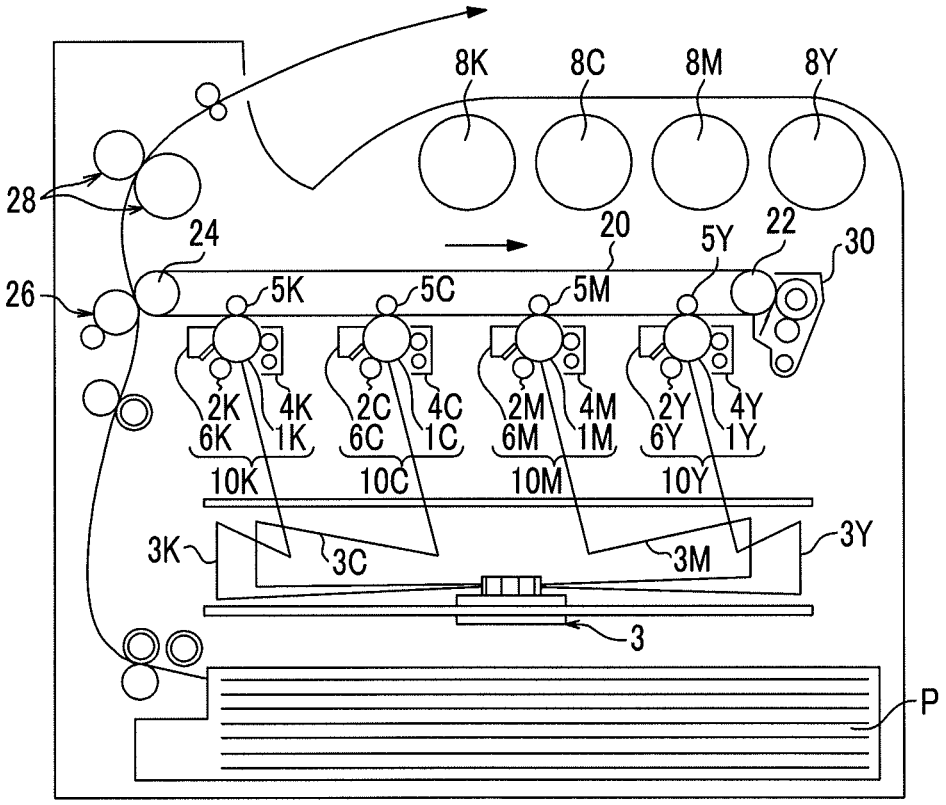
FIG. 1 is a schematic configuration diagram showing an example of an image forming apparatus according to the exemplary embodiment.

Hereinafter, the exemplary embodiments which are examples of the invention will be described in detail.

Electrostatic Charge Image Developing Toner

Electrostatic charge image developing toner according to the exemplary embodiment (hereinafter, referred to as "toner") includes toner particles containing an amorphous polyester resin (a1), a crystalline polyester resin (a2), and a styrene-acrylic resin (b) containing 2-carboxyethyl acrylate as a polymerization component.

With the toner according to the exemplary embodiment having the configuration as described above, it is possible to suppress generation of transfer unevenness in a half-tone image.

Reasons for such an effect are assumed as follows.

As a representative binder resin configuring the toner particles, an amorphous polyester resin is used.

The amorphous polyester resin is a resin for improving basic properties as the toner particles, in points of toughness and a charging property of the toner particles, and image intensity.

In recent years, in order to obtain a low temperature fixability of the toner particles, a technology of using a crystalline polyester resin in combination with the amorphous polyester resin describe above is used.

However, since the crystalline polyester resin is a low resistance resin, a charge holding ability of the toner particles tends to be decreased and transfer unevenness tends to be easily generated, by containing such a crystalline polyester resin.

Meanwhile, as the binder resin of the toner particles, the styrene-acrylic resin is also known, in addition to the polyester resin described above.

When the styrene-acrylic resin is used for the toner with the crystalline polyester resin described above, a resistance value of the entirety of toner particles increases and the toughness of the toner particles themselves also increases, and thus the toner is hardly crushed.

However, since the styrene-acrylic resin and the polyester resin are resins having different structures from each other, even though the resins are simply combined with each other, affinity of both resins is low, and accordingly, in toner particles using the resins in combination, a dispersion state of the resins easily becomes uneven and this also results in uneven resistance.

In particular, if using the styrene-acrylic resin, the crystalline polyester resin, and the amorphous polyester resin in combination, an intermolecular force between the amorphous polyester resin and the crystalline polyester resin increases, and those resins become compatible easily. Accordingly, an intermolecular force between the amorphous polyester resin and the styrene-acrylic resin decreases, affinity between the crystalline polyester resin and the amorphous polyester resin, and the styrene-acrylic resin further decreases, and a dispersion state of the resins in the toner particles is assumed to more easily become uneven.

In the toner according to the exemplary embodiment, in addition to the crystalline polyester resin and the amorphous polyester resin, a styrene-acrylic resin containing 2-carboxyethyl acrylate as a polymerization component is used in combination.

This is because, when a polymerization component derived from 2-carboxyethyl acrylate is present in the styrene-acrylic resin structure, an unshared electron pair of an oxygen atom of a carboxyethyl portion and an oxygen atom configuring carbonyl of an acrylate portion increases an intermolecular force between a carbon atom of an ester portion of the polyester resin and the styrene-acrylic resin, increases affinity between the styrene-acrylic resin and the crystalline and amorphous polyester resins, and accordingly both resins are slightly compatible.

Thus, in the exemplary embodiment, by combining three kinds of resins described above, dispersiveness of the resins in the toner becomes good, resistance of toner particles increases, and the toner itself is hardly crushed. As a result, with the toner according to the exemplary embodiment, it is considered to be possible to suppress generation of the transfer unevenness.

In addition, since the styrene-acrylic resin and the crystalline and amorphous polyester resins are compatible in the vicinity of the interfaces, clear interfaces are hardly generated, and image quality degradation due to cracks or deletion of an image when folding the formed image is suppressed.

As described above, with the toner according to the exemplary embodiment, it is expected that the generation of transfer unevenness is suppressed and the image quality degradation when folding the image is also suppressed.

If compatibility between the styrene-acrylic resin and the polyester resin remains in a low state, clear interfaces may be generated between the styrene-acrylic resin and the polyester resin, in an image obtained by the toner particles containing both resins.

As a result, the effects described above may not be obtained.

Hereinafter, details of the toner according to the exemplary embodiment will be described.

The toner according to the exemplary embodiment is configured to include toner particles, and if necessary, external additives.

Toner Particles

The toner particles are configured to include, for example, the amorphous polyester resin (a1), the crystalline polyester resin (a2), and the styrene-acrylic resin (b) containing 2-carboxyethyl acrylate as a polymerization component, as a binder resin, and include, if necessary, a colorant, a release agent, and other additives.

Binder Resin

As the binder resin, the amorphous polyester resin (a1), the crystalline polyester resin (a2), and the styrene-acrylic resin (b) containing 2-carboxyethyl acrylate as a polymerization component (hereinafter, appropriately referred to as a "specific styrene-acrylic resin") are used.

Specific Styrene-Acrylic Resin (b)

First, the specific styrene-acrylic resin will be described.

The specific styrene-acrylic resin used in the exemplary embodiment is a copolymer obtained by copolymerizing at least a styrene monomer and a (meth)acrylic monomer, and is a resin in which 2-carboxyethyl acrylate is used as the (meth) acrylic monomer.

The specific styrene-acrylic resin may be a copolymer obtained by copolymerizing other monomers in addition to a styrene monomer and a (meth)acrylic monomer.

Herein, "(meth)acryl" is an expression including both "acryl" and "methacryl".

The styrene monomer is a monomer including a styrene skeleton, and specific examples thereof include styrene; vinyl naphthalene; alkyl-substituted styrene such as α-methyl styrene, o-methylstyrene, m-methylstyrene, p-methylstyrene, p-ethyl styrene, 2,4-dimethyl styrene, p-n-butyl styrene, p-tert-butyl styrene, p-n-hexyl styrene, p-n-octyl styrene, p-n-nonyl styrene, p-n-decyl styrene, or p-n-dodecyl styrene; aryl-substituted styrene such as p-phenyl styrene; alkoxy-substituted styrene such as p-methoxy styrene; halogen-substituted styrene such as p-chlorostyrene, 3,4-dichloro styrene, 4-fluoro styrene, or 2,5-difluorostyrene; nitro-substituted styrene such as m-nitro styrene, o-nitro-styrene, or p-nitro styrene; and the like. Among them, as the styrene monomer, styrene, p-ethyl styrene, p-n-butyl styrene, and the like are preferable.

The styrene monomer may be used alone or in combination of two or more kinds thereof.

In the specific styrene-acrylic resin, a rate of the styrene monomer with respect to the entire polymerization component (that is, a rate of the polymerization component derived from the styrene monomer with respect to the weight of entire resin) is preferably equal to or greater than 60% by weight, more preferably from 65% by weight to 90% by weight, and even more preferably from 70% by weight to 85% by weight, from a viewpoint of suppressing the transfer unevenness.

The (meth)acrylic monomer is a monomer including a (meth)acryloyl group, and specific examples thereof include (meth)acrylic acid ester including 2-carboxyethyl acrylate.

Examples of (meth)acrylic acid ester include alkyl (meth) acrylate such as n-methyl (meth)acrylate, n-ethyl (meth)acrylate, n-propyl (meth)acrylate, n-butyl (meth)acrylate, n-pentyl (meth)acrylate, n-hexyl (meth)acrylate, n-heptyl (meth) acrylate, n-octyl (meth)acrylate, n-decyl (meth)acrylate, n-dodecyl (meth)acrylate, n-lauryl (meth)acrylate, n-tetradecyl (meth)acrylate, n-hexadecyl (meth)acrylate, n-octadecyl (meth)acrylate, isopropyl (meth)acrylate, isobutyl (meth) acrylate, t-butyl (meth)acrylate, isopentyl, (meth)acrylate, amyl (meth)acrylate, neopentyl (meth)acrylate, isohexyl (meth)acrylate, isoheptyl (meth)acrylate, isooctyl (meth) acrylate, 2-ethylhexyl (meth)acrylate, octyl (meth)acrylate, decyl (meth)acrylate, lauryl (meth)acrylate, or stearyl (meth) acrylate; carboxy-substituted alkyl (meth)acrylate such as 2-carboxyethyl (meth)acrylate; hydroxy-substituted alkyl (meth)acrylate such as 2-hydroxyethyl (meth)acrylate, 2-hydroxypropyl (meth)acrylate, 3-hydroxypropyl (meth)acrylate, 2-hydroxybutyl (meth)acrylate, 3-hydroxybutyl (meth) acrylate, or 4-hydroxybutyl (meth)acrylate; alkoxy-substituted alkyl (meth)acrylate such as 2-methoxyethyl (meth)acrylate; and the like.

Among these (meth)acrylic acid esters, it is preferable to use (meth)acrylic acid ester including an alkyl group having 2 to 14 carbon atoms (preferably 2 to 10 carbon atoms and more preferably 3 to 8 carbon atoms), from a viewpoint of fixability.

In addition, examples of the (meth)acrylic monomer include (meth)acrylic acid, decane diol diacrylate, or the like, in addition to the (meth)acrylic acid esters described above.

The (meth)acrylic monomers may be used alone or in combination of two or more kinds thereof, excluding 2-carboxyethyl acrylate.

A rate of 2-carboxyethyl acrylate with respect to the entire polymerization component (that is, a rate of the polymerization component derived from the (meth)acrylic monomer with respect to the weight of entire resin) is preferably from 0.001% by weight to 1.000% by weight, more preferably from 0.01% by weight to 0.6% by weight, and even more preferably from 0.02% by weight to 0.1% by weight, from viewpoints of further increasing compatibility between the specific styrene-acrylic resin and the amorphous and crystalline polyester resins and easily suppressing generation of transfer unevenness.

In addition, a rate of the (meth)acrylic monomer including 2-carboxyethyl acrylate with respect to the entire polymerization component (that is, a rate of the total amount of the polymerization component derived from the (meth)acrylic monomer with respect to the weight of entire resin) is preferably from 4% by weight to 40% by weight and more preferably from 10% by weight to 35% by weight, from a viewpoint of suppressing the generation of transfer unevenness.

Examples of other monomers include ethylenically unsaturated nitriles (acrylonitrile, methacrylonitrile, or the like), vinyl ethers (vinyl methyl ether, vinyl isobutyl ether, or the like), vinyl ketones (vinyl methyl ketone, vinyl ethyl ketone, vinyl isopropenyl ketone, or the like), divinyls (divinyl adipate or the like), olefins (ethylene, propylene, butadiene, or the like), and the like.

2-carboxyethyl acrylate in the specific styrene-acrylic resin is identified and quantized by 1H-NMR.

In addition, when measuring the content of 2-carboxyethyl acrylate in the specific styrene-acrylic resin contained in a developer, the toner, or the toner particles, after eliminating a carrier from the developer and eliminating an external additive from the toner, toner particles are dissolved with an organic solvent or the like, and a binder resin is separated by filtering or the like, and then such a binder resin can be provided to be measured by 1H-NMR.

As a 1H-NMR device, JNM-AL400 (manufactured by JEOL Ltd.) is used, and measurement conditions are set to include a glass tube of 5 mm, 3% by weight of a deuterochloroform solution, and a measurement temperature of 25° C.

A glass transition temperature (Tg) of the specific styrene-acrylic resin is preferably from 40° C. to 70° C. and more preferably from 50° C. to 65° C., from viewpoints of suppressing aggregation of toner in a developer unit and improving transfer unevenness in a half-tone image.

The glass transition temperature is acquired by a DSC curve obtained by differential scanning calorimetry (DSC), and more specifically, is acquired by "extrapolation glass transition starting temperature" disclosed in a method of acquiring the glass transition temperature of JIS K7121-1987 "Testing Methods for Transition Temperature of Plastics". Hereinafter, glass transition temperatures of other resins are also measured in the same manner as described above.

The weight-average molecular weight (Mw) of the styrene-acrylic resin is preferably from 5,000 to 200,000 and more preferably from 10,000 to 100,000, from viewpoints of obtaining excellent compatibility between the specific styrene-acrylic resin and the crystalline and amorphous polyester resins and improving transfer unevenness in a half-tone image.

The number-average molecular weight (Mn) of the polyester resin is preferably from 5,000 to 40,000.

The molecular weight distribution Mw/Mn of the styrene-acrylic resin is preferably from 2.0 to 6.0 and more preferably from 2.5 to 5.5.

The weight-average molecular weight and the number-average molecular weight are measured by gel permeation chromatography (GPC). The molecular weight measurement by GPC is performed with a THF solvent using HLC-8120 GPC, GPC manufactured by Tosoh Corporation as a measurement device and using TSKgel Super HM-M (15 cm), a column manufactured by Tosoh Corporation. The weight-average molecular weight and the number-average molecular weight are calculated using a calibration curve of molecular weight created with a monodisperse polystyrene standard sample from results of this measurement. Hereinafter, the molecular weight of other resins is measured in the same manner as described above.

A well-known polymerization method (radical polymerization method such as emulsion polymerization method or solution polymerization method) is used for synthesis of the specific styrene-acrylic resin.

The specific styrene-acrylic resin may be synthesized as resin particles by using the emulsion polymerization method described above. Particularly, when performing synthesis, it is preferable to use the emulsion polymerization method, from a viewpoint of forming resin particles in which the polymerization component derived from 2-carboxyethyl acrylate exists on the surface side. In detail, since 2-carboxyethyl acrylate, the acrylic monomer other than 2-carboxyethyl acrylate, and the styrene monomer generally tend to be easily polymerized in this order, 2-carboxyethyl acrylate which is a monomer which is most hardly polymerized is easily introduced to a terminal of the polymer. As a result, when the emulsion polymerization method with which the resin particles are obtained is used, it is considered that the polymerization component derived from 2-carboxyethyl acrylate is selectively introduced to the vicinity of the surface of the resin particles.

When the polymerization component derived from 2-carboxyethyl acrylate is introduced to the surface side of the resin particles, it is a preferable state since the specific styrene-acrylic resin and the amorphous and crystalline polyester resins are easily compatible.

The content of the specific styrene-acrylic resin may preferably be 1% by weight to 40% by weight (preferably 5% by weight to 30% by weight) with respect to the weight of the toner particles, from viewpoints of increasing a resistance value of the toner, increasing the toughness of the toner, and increasing compatibility between the specific styrene-acrylic resin and the amorphous and crystalline polyester resins.

In the toner particles, the polyester resins, which will be described later, are preferably dispersed as a matrix, and the specific styrene-acrylic resin is preferably dispersed as the resin particles.

Polyester Resin

In the exemplary embodiment, the amorphous polyester resin (a1) and the crystalline polyester resin (a2) are used as the binder resin.

The "crystalline" resin indicates one not having a stepwise change in the amount of heat absorbed, but a clear heat absorption peak in differential scanning calorimetry (DSC). Specifically, it indicates that the half value width of a heat absorption peak measured at a rate of temperature rise of 10 (° C./min) is within 10° C.

Meanwhile, the "amorphous" resin indicates one having a half value width of a heat absorption peak exceeding 10° C., exhibiting a stepwise change in the amount of heat absorbed, or having no clear heat absorption peak.

Amorphous Polyester Resin

Examples of the amorphous polyester resin include condensation polymers of polyvalent carboxylic acids and polyols. A commercially available product or a synthesized product may be used as the amorphous polyester resin.

Examples of the polyvalent carboxylic acid include aliphatic dicarboxylic acids (e.g., oxalic acid, malonic acid, maleic acid, fumaric acid, citraconic acid, itaconic acid, glutaconic acid, succinic acid, alkenyl succinic acid, adipic acid, and sebacic acid), alicyclic dicarboxylic acids (e.g., cyclohexanedicarboxylic acid), aromatic dicarboxylic acids (e.g., terephthalic acid, isophthalic acid, phthalic acid, and naphthalenedicarboxylic acid), anhydrides thereof, or lower alkyl esters (having, for example, from 1 to 5 carbon atoms) thereof. Among these, for example, aromatic dicarboxylic acids are preferably used as the polyvalent carboxylic acid.

As the polyvalent carboxylic acid, a tri- or higher-valent carboxylic acid employing a crosslinked structure or a branched structure may be used in combination together with a dicarboxylic acid. Examples of the tri- or higher-valent carboxylic acid include trimellitic acid, pyromellitic acid, anhydrides thereof, or lower alkyl esters (having, for example, from 1 to 5 carbon atoms) thereof.

The polyvalent carboxylic acids may be used alone or in combination of two or more kinds thereof.

Examples of the polyol include aliphatic diols (e.g., ethylene glycol, diethylene glycol, triethylene glycol, propylene glycol, butanediol, hexanediol, and neopentyl glycol), alicyclic diols (e.g., cyclohexanediol, cyclohexanedimethanol, and hydrogenated bisphenol A), and aromatic diols (e.g., ethylene oxide adduct of bisphenol A and propylene oxide adduct of bisphenol A). Among these, for example, aromatic diols and alicyclic diols are preferably used, and aromatic diols are more preferably used as the polyol.

As the polyol, a tri- or higher-valent polyol employing a crosslinked structure or a branched structure may be used in combination together with a diol. Examples of the tri- or higher-valent polyol include glycerin, trimethylolpropane, and pentaerythritol.

The polyols may be used alone or in combination of two or more kinds thereof.

The glass transition temperature (Tg) of the amorphous polyester resin is preferably from 50° C. to 80° C., and more preferably from 50° C. to 65° C.

The weight-average molecular weight (Mw) of the amorphous polyester resin is preferably from 5,000 to 1,000,000, and more preferably from 7,000 to 500,000.

The number-average molecular weight (Mn) of the amorphous polyester resin is preferably from 2,000 to 100,000.

The molecular weight distribution Mw/Mn of the amorphous polyester resin is preferably from 1.5 to 100, and more preferably from 2 to 60.

A known manufacturing method is applied to manufacture the amorphous polyester resin. Specific examples thereof include a method of conducting a reaction at a polymerization temperature set to 180° C. to 230° C., if necessary, under reduced pressure in the reaction system, while removing water or an alcohol generated during condensation.

When monomers of the raw materials are not dissolved or compatibilized under a reaction temperature, a high-boiling-point solvent may be added as a solubilizing agent to dissolve the monomers. In this case, a polycondensation reaction is conducted while distilling away the solubilizing agent. When a monomer having poor compatibility is present in a copolymerization reaction, the monomer having poor compatibility and an acid or an alcohol to be polycondensed with the monomer may be previously condensed and then polycondensed with the major component.

Crystalline Polyester Resin

Examples of the crystalline polyester resin include polycondensates of polyvalent carboxylic acids and polyols. A commercially available product or a synthesized product may be used as the crystalline polyester resin.

Here, as the crystalline polyester resin, a polycondensate using a polymerizable monomer having a linear aliphatic group is preferably used rather than a polymerizable monomer having an aromatic group, in order to easily form a crystal structure.

Examples of the polyvalent carboxylic acid include aliphatic dicarboxylic acids (e.g., oxalic acid, succinic acid, glutaric acid, adipic acid, suberic acid, azelaic acid, sebacic acid, 1,9-nonanedicarboxylic acid, 1,10-decanedicarboxylic acid, 1,12-dodecanedicarboxylic acid, 1,14-tetradecanedicarboxylic acid, and 1,18-octadecanedicarboxylic acid), aromatic dicarboxylic acids (e.g., dibasic acids such as phthalic acid, isophthalic acid, terephthalic acid, naphthalene-2,6-dicarboxylic acid, malonic acid, and mesaconic acid), anhydrides thereof, or lower alkyl esters (having, for example, from 1 to 5 carbon atoms) thereof.

As the polyvalent carboxylic acid, a tri- or higher-valent carboxylic acid employing a crosslinked structure or a branched structure may be used in combination together with a dicarboxylic acid. Examples of the trivalent carboxylic acid include aromatic carboxylic acids (e.g., 1,2,3-benzenetricarboxylic acid, 1,2,4-benzenetricarboxylic acid, and 1,2,4-naphthalenetricarboxylic acid), anhydrides thereof, or lower alkyl esters (having, for example, from 1 to 5 carbon atoms) thereof.

As the polyvalent carboxylic acid, a dicarboxylic acid having a sulfonic acid group or a dicarboxylic acid having an ethylenic double bond may be used in combination together with these dicarboxylic acids.

The polyvalent carboxylic acids may be used alone or in combination of two or more kinds thereof.

Examples of the polyol include aliphatic diols (e.g., linear aliphatic diols having 7 to 20 carbon atoms in a main chain part). Examples of the aliphatic diols include ethylene glycol, 1,3-propanediol, 1,4-butanediol, 1,5-pentanediol, 1,6-hexanediol, 1,7-heptanediol, 1,8-octanediol, 1,9-nonanediol, 1,10-decanediol, 1,11-undecanediol, 1,12-dodecanediol, 1,13-tridecanediol, 1,14-tetradecanediol, 1,18-octadecanediol, and 1,14-eicosanedecanediol. Among these, 1,8-octanediol, 1,9-nonanediol, and 1,10-decanediol are preferably used as the aliphatic diol.

As the polyol, a tri- or higher-valent polyol employing a crosslinked structure or a branched structure may be used in combination together with a diol. Examples of the tri- or higher-valent polyol include glycerin, trimethylolethane, trimethylolpropane, and pentaerythritol.

The polyols may be used alone or in combination of two or more kinds thereof.

Here, in the polyol, the content of the aliphatic diol may be 80% by mol or greater, and preferably 90% by mol or greater.

The melting temperature of the crystalline polyester resin is preferably from 50° C. to 100° C., more preferably from 55° C. to 90° C., and even more preferably from 60° C. to 85° C.

The melting temperature is obtained from "melting peak temperature" described in the method of obtaining a melting temperature in JIS K 7121-1987 "testing methods for transition temperatures of plastics", from a DSC curve obtained by differential scanning calorimetry (DSC).

The weight-average molecular weight (Mw) of the crystalline polyester resin is preferably from 6,000 to 35,000.

For example, a known manufacturing method is used to manufacture the crystalline polyester resin as in the case of the amorphous polyester resin.

Herein, the content of the crystalline polyester resin may preferably be 2% by weight to 30% by weight (preferably 4% by weight to 20% by weight) with respect to the weight of the toner particles, from viewpoints of obtaining low temperature fixability, suppressing degradation of electrical resistance, and obtaining an excellent half-tone image.

In addition, the total amount of the amorphous and crystalline polyester resins may be 50% by weight to 90% by weight (preferably from 60% by weight to 80% by weight) with respect to the weight of the toner particles.

Other Resins

As the binder resin, other resins may be used, in a range of not degrading the effects obtained with the combination of the specific styrene-acrylic resin (b), the amorphous polyester resin (a1), and the crystalline polyester resin (a2) described above.

Examples of the other resins include a vinyl resin other than the specific styrene-acrylic resin, a non-vinyl resin such as an acrylic resin, an epoxy resin, a polyurethane resin, a polyamide resin, a cellulose resin, a polyether resin, a modified rosin, and the like.

The total content of the binder resin is, for example, preferably from 40% by weight to 95% by weight, more preferably from 50% by weight to 90% by weight, and even more preferably from 60% by weight to 90% by weight with respect to the entirety of the toner particles. A weight ratio (a1):(a2) (b) of the amorphous polyester resin (a1), the crystalline polyester resin (a2), and the styrene-acrylic resin (b) containing 2-carboxyethyl acrylate as a polymerization component is in a range of 2 to 9:0.2 to 3:0.1 to 4.

Colorant

Examples of the colorant include various pigments such as carbon black, chrome yellow, Hansa yellow, benzidine yellow, threne yellow, quinoline yellow, pigment yellow, permanent orange GTR, pyrazolone orange, vulcan orange, watchung red, permanent red, brilliant carmine 3B, brilliant carmine 6B, DuPont oil red, pyrazolone red, lithol red, Rhodamine B Lake, Lake Red C, pigment red, rose bengal, aniline blue, ultramarine blue, calco oil blue, methylene blue chloride, phthalocyanine blue, pigment blue, phthalocyanine green, and malachite green oxalate, and various dyes such as acridine dyes, xanthene dyes, azo dyes, benzoquinone dyes, azine dyes, anthraquinone dyes, thioindigo dyes, dioxadine dyes, thiazine dyes, azomethine dyes, indigo dyes, phthalocyanine dyes, aniline black dyes, polymethine dyes, triphenylmethane dyes, diphenylmethane dyes, and thiazole dyes.

The colorants may be used alone or in combination of two or more kinds thereof.

If necessary, the colorant may be surface-treated or used in combination with a dispersing agent. Plural kinds of colorants may be used in combination.

The content of the colorant is, for example, preferably from 1% by weight to 30% by weight, and more preferably from 3% by weight to 15% by weight with respect to the entirety of the toner particles.

Release Agent

Examples of the release agent include, hydrocarbon waxes; natural waxes such as carnauba wax, rice wax, and candelilla wax; synthetic or mineral/petroleum waxes such as montan wax; and ester waxes such as fatty acid esters and montanic acid esters. The release agent is not limited thereto.

The melting temperature of the release agent is preferably from 50° C. to 110° C., and more preferably from 60° C. to 100° C.

The melting temperature is obtained from "melting peak temperature" described in the method of obtaining a melting temperature in JIS K7121-1987 "testing methods for transition temperatures of plastics", from a DSC curve obtained by differential scanning calorimetry (DSC).

The content of the release agent is, for example, preferably from 1% by weight to 20% by weight, and more preferably from 5% by weight to 15% by weight with respect to the entirety of the toner particles.

Other Additives

Examples of other additives include known additives such as a magnetic material, a charge-controlling agent, and an inorganic powder. The toner particles contain these additives as internal additives.

Characteristics of Toner Particles

The toner particles may be toner particles having a single-layer structure, or toner particles having a so-called core/shell structure composed of a core (core particle) and a coating layer (shell layer) coated on the core.

Here, toner particles having a core/shell structure is preferably composed of, for example, a core containing a binder resin, and if necessary, other additives such as a colorant and a release agent and a coating layer containing a binder resin.

As the binder resin for forming a coating layer, the specific styrene-acrylic resin (b) described above is preferably used.

The volume average particle diameter (D50v) of the toner particles is preferably from 2 μm to 10 μm, and more preferably from 4 μm to 8 μm.

Various average particle diameters and various particle size distribution indices of the toner particles are measured using a Coulter Multisizer II (manufactured by Beckman Coulter, Inc.) and ISOTON-II (manufactured by Beckman Coulter, Inc.) as an electrolyte.

In the measurement, from 0.5 mg to 50 mg of a measurement sample is added to 2 ml of a 5% aqueous solution of surfactant (preferably sodium alkylbenzene sulfonate) as a dispersing agent. The obtained material is added to 100 ml to 150 ml of the electrolyte.

The electrolyte in which the sample is suspended is subjected to a dispersion treatment using an ultrasonic disperser for 1 minute, and a particle size distribution of particles having a particle diameter of 2 μm to 60 μm is measured by a Coulter Multisizer II using an aperture having an aperture diameter of 100 μm. 50,000 particles are sampled.

Cumulative distributions by volume and by number are drawn from the side of the smallest diameter with respect to particle size ranges (channels) separated based on the measured particle size distribution. The particle diameter when the cumulative percentage becomes 16% is defined as that corresponding to a volume average particle diameter D16v and a number-average particle diameter D16p, while the particle diameter when the cumulative percentage becomes 50% is defined as that corresponding to a volume average particle diameter D50v and a number-average particle diameter D50p. Furthermore, the particle diameter when the cumulative percentage becomes 84% is defined as that corresponding to a volume average particle diameter D84v and a number-average particle diameter D84p.

Using these, a volume average particle size distribution index (GSDv) is calculated as $(D84v/D16v)^{1/2}$, while a number-average particle size distribution index (GSDp) is calculated as $(D84p/D16p)^{1/2}$.

The shape factor SF1 of the toner particles is preferably from 110 to 150, and more preferably from 120 to 140.

The shape factor SF1 is obtained through the following expression.

$$SF1=(ML^2/A)\times(n/4)\times 100 \qquad \text{Expression:}$$

In the foregoing expression, ML represents an absolute maximum length of a toner particle, and A represents a projected area of a toner particle.

Specifically, the shape factor SF1 is numerically converted mainly by analyzing a microscopic image or a scanning electron microscopic (SEM) image by the use of an image analyzer, and is calculated as follows. That is, an optical microscopic image of particles scattered on a surface of a glass slide is input to an image analyzer Luzex through a video camera to obtain maximum lengths and projected areas of 100 particles, values of SF1 are calculated through the foregoing expression, and an average value thereof is obtained.

External Additive

Examples of the external additive include inorganic particles. Examples of the inorganic particles include $SiO_2$, $TiO_2$, $Al_2O_3$, CuO, ZnO, $SnO_2$, $CeO_2$, $Fe_2O_3$, MgO, BaO, CaO, $K_2O$, $Na_2O$, $ZrO_2$, $CaO.SiO_2$, $K_2O.(TiO_2)_n$, $Al_2O_3.2SiO_2$, $CaCO_3$, $MgCO_3$, $BaSO_4$, and $MgSO_4$.

Surfaces of the inorganic particles as an external additive are preferably subjected to a hydrophobizing treatment. The hydrophobizing treatment is performed by, for example, dipping the inorganic particles in a hydrophobizing agent. The hydrophobizing agent is not particularly limited and examples thereof include a silane coupling agent, silicone oil, a titanate coupling agent, and an aluminum coupling agent. These may be used alone or in combination of two or more kinds thereof.

Generally, the amount of the hydrophobizing agent is, for example, from 1 part by weight to 10 parts by weight with respect to 100 parts by weight of the inorganic particles.

Examples of the external additive also include resin particles (resin particles such as polystyrene, polymethyl methacrylate (PMMA), and melamine resin particles) and a cleaning aid (e.g., metal salt of higher fatty acid represented by zinc stearate, and fluorine-based polymer particles).

The amount of the external additive externally added is, for example, preferably from 0.01% by weight to 5% by weight, and more preferably from 0.01% by weight to 2.0% by weight with respect to the toner particles.

Toner Preparing Method

Next, a method of preparing a toner according to this exemplary embodiment will be described.

The toner according to this exemplary embodiment is obtained by externally adding an external additive to toner particles after preparing of the toner particles, if necessary.

The toner particles may be prepared using any of a dry preparing method (e.g., kneading and pulverizing method) and a wet preparing method (e.g., aggregation and coalescence method, suspension and polymerization method, and dissolution and suspension method). The toner particle preparing method is not particularly limited to these preparing methods, and a known preparing method is employed.

Among these, the toner particles are preferably obtained by an aggregation and coalescence method.

Specifically, for example, when the toner particles are prepared by an aggregation and coalescence method, the toner particles are prepared through the processes of: preparing a resin particle dispersion in which resin particles as a binder resin are dispersed (resin particle dispersion preparation process); aggregating the resin particles (if necessary, other particles) in the resin particle dispersion (if necessary, in the dispersion after mixing with other particle dispersions) to form aggregated particles (aggregated particle forming process); and heating the aggregated particle dispersion in which the aggregated particles are dispersed, to coalesce the aggregated particles, thereby forming toner particles (coalescence process).

Hereinafter, the respective processes will be described in detail.

In the following description, a method of obtaining toner particles containing a colorant and a release agent will be described, but the colorant and the release agent are only used if necessary. Additives other than the colorant and the release agent may also be used.

Resin Particle Dispersion Preparation Process

First, for example, a colorant particle dispersion in which colorant particles are dispersed and a release agent particle dispersion in which release agent particles are dispersed are prepared together with a resin particle dispersion in which resin particles as a binder resin are dispersed.

Herein, the resin particle dispersion is prepared by, for example, dispersing resin particles by a surfactant in a dispersion medium.

In the exemplary embodiment, a resin particle dispersion in which the resin particles formed of the amorphous polyester resin (a1) are dispersed, a resin particle dispersion in which the resin particles formed of the crystalline polyester resin (a2) are dispersed, and a resin particle dispersion in which the resin particles formed of the specific styrene-acrylic resin (b) are dispersed, are prepared.

The specific styrene-acrylic resin particle dispersion is preferably prepared by using the emulsion polymerization method. Particularly, when preparing the resin particle dispersion in which the resin particles formed of the specific styrene-acrylic resin (b) are dispersed, it is preferable to use the emulsion polymerization method, since resin particles in which the polymerization component derived from 2-carboxyethyl acrylate exists on the surface is formed and the compatibility with the amorphous polyester resin (a1) and the crystalline polyester resin (a2) is easily obtained by such a polymerization component.

Examples of the dispersion medium used for the resin particle dispersion include aqueous mediums.

Examples of the aqueous mediums include water such as distilled water and ion exchange water, and alcohols. These may be used alone or in combination of two or more kinds thereof.

Examples of the surfactant include anionic surfactants such as sulfuric ester salt, sulfonate, phosphate, and soap; cationic surfactants such as amine salt and quaternary ammonium salt; and nonionic surfactants such as polyethylene glycol, alkyl phenol ethylene oxide adduct, and polyol. Among these, anionic surfactants and cationic surfactants are particularly used. Nonionic surfactants may be used in combination with anionic surfactants or cationic surfactants.

The surfactants may be used alone or in combination of two or more kinds thereof.

Regarding the resin particle dispersion, as a method of dispersing the resin particles in the dispersion medium, a common dispersing method using, for example, a rotary shearing-type homogenizer, or a ball mill, a sand mill, or a Dyno mill having media is exemplified. Depending on the kind of the resin particles, resin particles may be dispersed in the resin particle dispersion using, for example, a phase inversion emulsification method.

The phase inversion emulsification method includes: dissolving a resin to be dispersed in a hydrophobic organic solvent in which the resin is soluble; conducting neutralization by adding a base to an organic continuous phase (O phase); and converting the resin (so-called phase inversion) from W/O to O/W by putting an aqueous medium (W phase) to form a discontinuous phase, thereby dispersing the resin as particles in the aqueous medium.

The volume average particle diameter of the resin particles dispersed in the resin particle dispersion is, for example, preferably from 0.01 μm to 1 μm, more preferably from 0.08 μm to 0.8 μm, and even more preferably from 0.1 μm to 0.6 μm.

Regarding the volume average particle diameter of the resin particles, a cumulative distribution by volume is drawn from the side of the smallest diameter with respect to particle size ranges (channels) separated using the particle size distribution obtained by the measurement of a laser diffraction-type particle size distribution measuring device (for example, manufactured by Horiba, Ltd., LA-700), and a particle diameter when the cumulative percentage becomes 50% with respect to the entirety of the particles is measured as a volume average particle diameter D50v. The volume average particle diameter of the particles in other dispersions is also measured in the same manner.

The content of the resin particles contained in the resin particle dispersion is, for example, preferably from 5% by weight to 50% by weight, and more preferably from 10% by weight to 40% by weight.

For example, the colorant particle dispersion and the release agent particle dispersion are also prepared in the same manner as in the case of the resin particle dispersion. That is, the particles in the resin particle dispersion are the same as the colorant particles dispersed in the colorant particle dispersion and the release agent particles dispersed in the release agent particle dispersion, in terms of the volume average particle diameter, the dispersion medium, the dispersing method, and the content of the particles.

Aggregated Particle Forming Process

Next, the colorant particle dispersion and the release agent dispersion are mixed together with the resin particle dispersion.

The resin particles, the colorant particles, and the release agent particles are heterogeneously aggregated in the mixed dispersion, thereby forming aggregated particles having a diameter near a target toner particle diameter and including the resin particles, the colorant particles, and the release agent particles.

Specifically, for example, an aggregating agent is added to the mixed dispersion and a pH of the mixed dispersion is adjusted to acidity (for example, the pH is from 2 to 5). If necessary, a dispersion stabilizer is added. Then, the mixed dispersion is heated at a temperature of the glass transition temperature of the resin particles (specifically, for example, from a temperature 30° C. lower than the glass transition temperature of the resin particles to a temperature 10° C. lower than the glass transition temperature) to aggregate the particles dispersed in the mixed dispersion, thereby forming the aggregated particles.

In the aggregated particle forming process, for example, the aggregating agent may be added at room temperature (for example, 25° C.) under stirring of the mixed dispersion using a rotary shearing-type homogenizer, the pH of the mixed dispersion may be adjusted to acidity (for example, the pH is from 2 to 5), a dispersion stabilizer may be added if necessary, and the heating may then be performed.

Examples of the aggregating agent include a surfactant having an opposite polarity to the polarity of the surfactant used as the dispersing agent to be added to the mixed dispersion, such as inorganic metal salts and di- or higher-valent metal complexes. Particularly, when a metal complex is used as the aggregating agent, the amount of the surfactant used is reduced and charging characteristics are improved.

If necessary, an additive may be used to form a complex or a similar bond with the metal ions of the aggregating agent. A chelating agent is preferably used as the additive.

Examples of the inorganic metal salts include metal salts such as calcium chloride, calcium nitrate, barium chloride, magnesium chloride, zinc chloride, aluminum chloride, and aluminum sulfate, and inorganic metal salt polymers such as polyaluminum chloride, polyaluminum hydroxide, and calcium polysulfide.

A water-soluble chelating agent may be used as the chelating agent. Examples of the chelating agent include oxycarboxylic acids such as tartaric acid, citric acid, and gluconic acid, iminodiacetic acid (IDA), nitrilotriacetic acid (NTA), and ethylenediaminetetraacetic acid (EDTA).

The amount of the chelating agent added is, for example, preferably from 0.01 part by weight to 5.0 parts by weight, and more preferably from 0.1 part by weight to less than 3.0 parts by weight with respect to 100 parts by weight of the resin particles.

Coalescence Process

Next, the aggregated particle dispersion in which the aggregated particles are dispersed is heated at, for example, a temperature that is equal to or higher than the glass transition temperature of the resin particles (for example, a temperature that is higher than the glass transition temperature of the resin particles by 10° C. to 30° C.) to coalesce the aggregated particles and form toner particles.

Toner particles are obtained through the foregoing processes.

After the aggregated particle dispersion in which the aggregated particles are dispersed is obtained, toner particles may be prepared through the processes of: further mixing the resin particle dispersion in which the resin particles are dispersed with the aggregated particle dispersion to conduct aggregation so that the resin particles (in the exemplary embodiment, preferably the specific styrene-acrylic resin (b)) further adhere to the surfaces of the aggregated particles, thereby forming second aggregated particles; and coalescing the second aggregated particles by heating the second aggregated particle dispersion in which the second aggregated particles are dispersed, thereby forming toner particles having a core/shell structure.

After the coalescence process ends, the toner particles formed in the solution are subjected to a washing process, a solid-liquid separation process, and a drying process, that are well known, and thus dry toner particles are obtained.

In the washing process, preferably, displacement washing using ion exchange water is sufficiently performed from the viewpoint of charging properties. In addition, the solid-liquid separation process is not particularly limited, but suction filtration, pressure filtration, or the like is preferably performed from the viewpoint of productivity. The method for the drying process is also not particularly limited, but freeze drying, flash jet drying, fluidized drying, vibration-type fluidized drying, or the like is preferably performed from the viewpoint of productivity.

The toner according to this exemplary embodiment is prepared by, for example, adding and mixing an external additive with dry toner particles that have been obtained. The mixing is preferably performed with, for example, a V-blender, a Henschel mixer, a Lödige mixer, or the like. Furthermore, if necessary, coarse toner particles may be removed using a vibration sieving machine, a wind-power sieving machine, or the like.

Electrostatic Charge Image Developer

An electrostatic charge image developer according to this exemplary embodiment includes at least the toner according to this exemplary embodiment.

The electrostatic charge image developer according to this exemplary embodiment may be a single-component developer including only the toner according to this exemplary embodiment, or a two-component developer obtained by mixing the toner with a carrier.

The carrier is not particularly limited, and known carriers are exemplified. Examples of the carrier include a coated carrier in which surfaces of cores formed of a magnetic powder are coated with a coating resin; a magnetic powder dispersion-type carrier in which a magnetic powder is dispersed and blended in a matrix resin; and a resin impregnation-type carrier in which a porous magnetic powder is impregnated with a resin.

The magnetic powder dispersion-type carrier and the resin impregnation-type carrier may be carriers in which constituent particles of the carrier are cores and coated with a coating resin.

Examples of the magnetic powder include magnetic metals such as iron, nickel, and cobalt, and magnetic oxides such as ferrite and magnetite.

Examples of the conductive particles include particles of metals such as gold, silver, and copper, carbon black particles, titanium oxide particles, zinc oxide particles, tin oxide particles, barium sulfate particles, aluminum borate particles, and potassium titanate particles.

Examples of the coating resin and the matrix resin include polyethylene, polypropylene, polystyrene, polyvinyl acetate, polyvinyl alcohol, polyvinyl butyral, polyvinyl chloride, polyvinyl ether, polyvinyl ketone, a vinyl chloride-vinyl acetate copolymer, a styrene-acrylic acid copolymer, a straight silicone resin configured to include an organosiloxane bond or a modified product thereof, a fluororesin, polyester, polycarbonate, a phenol resin, and an epoxy resin.

The coating resin and the matrix resin may contain other additives such as a conductive material.

Here, a coating method using a coating layer forming solution in which a coating resin, and if necessary, various additives are dissolved in an appropriate solvent is used to coat the surface of a core with the coating resin. The solvent is not particularly limited, and may be selected in consideration of the coating resin to be used, coating suitability, and the like.

Specific examples of the resin coating method include a dipping method of dipping cores in a coating layer forming solution, a spraying method of spraying a coating layer forming solution to surfaces of cores, a fluid bed method of spraying a coating layer forming solution in a state in which cores are allowed to float by flowing air, and a kneader-coater method in which cores of a carrier and a coating layer forming solution are mixed with each other in a kneader-coater and the solvent is removed.

The mixing ratio (weight ratio) between the toner and the carrier in the two-component developer is preferably from 1:100 to 30:100, and more preferably from 3:100 to 20:100 (toner:carrier).

Image Forming Apparatus/Image Forming Method

An image forming apparatus and an image forming method according to this exemplary embodiment will be described.

The image forming apparatus according to this exemplary embodiment is provided with an image holding member, a charging unit that charges a surface of the image holding member, an electrostatic charge image forming unit that forms an electrostatic charge image on a charged surface of the image holding member, a developing unit that contains an electrostatic charge image developer and develops the electrostatic charge image formed on the surface of the image holding member with the electrostatic charge image developer as a toner image, a transfer unit that transfers the toner image formed on the surface of the image holding member onto a surface of a recording medium, and a fixing unit that fixes the toner image transferred onto the surface of the recording medium. As the electrostatic charge image developer, the electrostatic charge image developer according to this exemplary embodiment is applied.

In the image forming apparatus according to this exemplary embodiment, an image forming method (image forming method according to this exemplary embodiment) including a charging process of charging a surface of an image holding member, an electrostatic charge image forming process of forming an electrostatic charge image on the charged surface of the image holding member, a developing process of developing the electrostatic charge image formed on the surface of the image holding member with the electrostatic charge image developer according to this exemplary embodiment as a toner image, a transfer process of transferring the toner image formed on the surface of the image holding member onto a surface of a recording medium, and a fixing process of fixing the toner image transferred onto the surface of the recording medium is performed.

As the image forming apparatus according to this exemplary embodiment, a known image forming apparatus is applied, such as a direct transfer-type apparatus that directly transfers a toner image formed on a surface of an image holding member onto a recording medium; an intermediate transfer-type apparatus that primarily transfers a toner image formed on a surface of an image holding member onto a surface of an intermediate transfer member, and secondarily transfers the toner image transferred onto the surface of the intermediate transfer member onto a surface of a recording medium; an apparatus that is provided with a cleaning unit that cleans a surface of an image holding member after transfer of a toner image and before charging; or an apparatus that is provided with an erasing unit that irradiates, after transfer of a toner image and before charging, a surface of an image holding member with erasing light for erasing.

In the case of an intermediate transfer-type apparatus, a transfer unit has, for example, an intermediate transfer member having a surface onto which a toner image is to be transferred, a primary transfer unit that primarily transfers a toner image formed on a surface of an image holding member onto the surface of the intermediate transfer member, and a secondary transfer unit that secondarily transfers the toner image transferred onto the surface of the intermediate transfer member onto a surface of a recording medium.

In the image forming apparatus according to this exemplary embodiment, for example, a part including the developing unit may have a cartridge structure (process cartridge) that is detachable from the image forming apparatus. As the process cartridge, for example, a process cartridge that accommodates the electrostatic charge image developer according to this exemplary embodiment and is provided with a developing unit is preferably used.

Hereinafter, an example of the image forming apparatus according to this exemplary embodiment will be shown. However, this image forming apparatus is not limited thereto. Major parts shown in the drawing will be described, but descriptions of other parts will be omitted.

FIG. 1 is a schematic diagram showing a configuration of the image forming apparatus according to this exemplary embodiment.

The image forming apparatus shown in FIG. 1 is provided with first to fourth electrophotographic image forming units 10Y, 10M, 10C, and 10K (image forming units) that output yellow (Y), magenta (M), cyan (C), and black (K) images based on color-separated image data, respectively. These image forming units (hereinafter, may be simply referred to as "units") 10Y, 10M, 10C, and 10K are arranged side by side at predetermined intervals in a horizontal direction. These units 10Y, 10M, 10C, and 10K may be process cartridges that are detachable from the image forming apparatus.

An intermediate transfer belt 20 as an intermediate transfer member is installed above the units 10Y, 10M, 10C, and 10K in the drawing to extend through the units. The intermediate transfer belt 20 is wound on a driving roll 22 and a support roll 24 contacting the inner surface of the intermediate transfer belt 20, which are disposed to be separated from each other on the left and right sides in the drawing, and travels in a direction toward the fourth unit 10K from the first unit 10Y. The support roll 24 is pressed in a direction in which it departs from the driving roll 22 by a spring or the like (not shown), and a tension is given to the intermediate transfer belt 20 wound on both of the rolls. In addition, an intermediate transfer member cleaning device 30 opposed to the driving roll 22 is provided on a surface of the intermediate transfer belt 20 on the image holding member side.

Developing devices (developing units) 4Y, 4M, 4C, and 4K of the units 10Y, 10M, 10C, and 10K are supplied with toner including four color toner, that is, a yellow toner, a magenta toner, a cyan toner, and a black toner accommodated in toner cartridges 8Y, 8M, 8C, and 8K, respectively.

The first to fourth units 10Y, 10M, 10C, and 10K have the same configuration, and accordingly, only the first unit 10Y that is disposed on the upstream side in a traveling direction of the intermediate transfer belt to form a yellow image will be representatively described herein. The same parts as in the first unit 10Y will be denoted by the reference numerals with magenta (M), cyan (C), and black (K) added instead of yellow (Y), and descriptions of the second to fourth units 10M, 10C, and 10K will be omitted.

The first unit 10Y has a photoreceptor 1Y acting as an image holding member. Around the photoreceptor 1Y, a charging roll (an example of the charging unit) 2Y that charges a surface of the photoreceptor 1Y to a predetermined potential, an exposure device (an example of the electrostatic charge image forming unit) 3 that exposes the charged surface with laser beams 3Y based on a color-separated image signal to form an electrostatic charge image, a developing device (an example of the developing unit) 4Y that supplies a charged toner to the electrostatic charge image to develop the electrostatic charge image, a primary transfer roll (an example of the primary transfer unit) 5Y that transfers the developed toner image onto the intermediate transfer belt 20, and a photoreceptor cleaning device (an example of the cleaning unit) 6Y that removes the toner remaining on the surface of the photoreceptor 1Y after primary transfer, are arranged in sequence.

The primary transfer roll 5Y is disposed inside the intermediate transfer belt 20 to be provided at a position opposed to the photoreceptor 1Y. Furthermore, bias supplies (not shown) that apply a primary transfer bias are connected to the primary transfer rolls 5Y, 5M, 5C, and 5K, respectively. Each bias supply changes a transfer bias that is applied to each primary transfer roll under the control of a controller (not shown).

Hereinafter, an operation of forming a yellow image in the first unit 10Y will be described.

First, before the operation, the surface of the photoreceptor 1Y is charged to a potential of −600 V to −800 V by the charging roll 2Y.

The photoreceptor 1Y is formed by laminating a photosensitive layer on a conductive substrate (for example, volume resistivity at 20° C.: $1\times10^{-6}$ Ωcm or less). The photosensitive layer typically has high resistance (that is about the same as the resistance of a general resin), but has properties in which when laser beams 3Y are applied, the specific resistance of a part irradiated with the laser beams changes. Accordingly, the laser beams 3Y are output to the charged surface of the photoreceptor 1Y via the exposure device 3 in accordance with image data for yellow sent from the controller (not shown). The laser beams 3Y are applied to the photosensitive layer on the surface of the photoreceptor 1Y, whereby an electrostatic charge image of a yellow image pattern is formed on the surface of the photoreceptor 1Y.

The electrostatic charge image is an image that is formed on the surface of the photoreceptor 1Y by charging, and is a so-called negative latent image, that is formed by applying laser beams 3Y to the photosensitive layer so that the specific resistance of the irradiated part is lowered to cause charges to flow on the surface of the photoreceptor 1Y, while charges stay on a part to which the laser beams 3Y are not applied.

The electrostatic charge image formed on the photoreceptor 1Y is rotated up to a predetermined developing position with the travelling of the photoreceptor 1Y. The electrostatic charge image on the photoreceptor 1Y is visualized (developed) as a toner image at the developing position by the developing device 4Y.

The developing device 4Y accommodates, for example, an electrostatic charge image developer including at least a yellow toner and a carrier. The yellow toner is frictionally charged by being stirred in the developing device 4Y to have a charge with the same polarity (negative polarity) as the charge that is on the photoreceptor 1Y, and is thus held on the developer roll (an example of the developer holding member). By allowing the surface of the photoreceptor 1Y to pass through the developing device 4Y, the yellow toner electrostatically adheres to the latent image part having been erased on the surface of the photoreceptor 1Y, whereby the latent image is developed with the yellow toner. Next, the photoreceptor 1Y having the yellow toner image formed thereon continuously travels at a predetermined rate and the toner image developed on the photoreceptor 1Y is transported to a predetermined primary transfer position.

When the yellow toner image on the photoreceptor 1Y is transported to the primary transfer position, a primary transfer bias is applied to the primary transfer roll 5Y and an electrostatic force toward the primary transfer roll 5Y from the photoreceptor 1Y acts on the toner image, whereby the toner image on the photoreceptor 1Y is transferred onto the intermediate transfer belt 20. The transfer bias applied at this time has the opposite polarity (+) to the toner polarity (−), and, for example, is controlled to +10 μA in the first unit 10Y by the controller (not shown).

On the other hand, the toner remaining on the photoreceptor 1Y is removed and collected by the photoreceptor cleaning device 6Y.

The primary transfer biases that are applied to the primary transfer rolls 5M, 5C, and 5K of the second unit 10M and the subsequent units are also controlled in the same manner as in the case of the first unit.

In this manner, the intermediate transfer belt 20 onto which the yellow toner image is transferred in the first unit 10Y is sequentially transported through the second to fourth units 10M, 10C, and 10K, and the toner images of respective colors are multiply-transferred in a superimposed manner.

The intermediate transfer belt 20 onto which the four color toner images have been multiply-transferred through the first to fourth units reaches a secondary transfer part that is composed of the intermediate transfer belt 20, the support roll 24 contacting the inner surface of the intermediate transfer belt, and a secondary transfer roll (an example of the secondary transfer unit) 26 disposed on the image holding surface side of the intermediate transfer belt 20. Meanwhile, a recording sheet (an example of the recording medium) P is supplied to a gap between the secondary transfer roll 26 and the intermediate transfer belt 20, that are brought into contact with each other, via a supply mechanism at a predetermined timing, and a secondary transfer bias is applied to the support roll 24. The transfer bias applied at this time has the same polarity (−) as the toner polarity (−), and an electrostatic force toward the recording sheet P from the intermediate transfer belt 20 acts on the toner image, whereby the toner image on the intermediate transfer belt 20 is transferred onto the recording sheet P. In this case, the secondary transfer bias is determined depending on the resistance detected by a resistance detector (not shown) that detects the resistance of the secondary transfer part, and is voltage-controlled.

Thereafter, the recording sheet P is fed to a pressure-contacting part (nip part) between a pair of fixing rolls in a fixing device (an example of the fixing unit) 28 so that the toner image is fixed to the recording sheet P, whereby a fixed image is formed.

Examples of the recording sheet P onto which a toner image is transferred include plain paper that is used in electrophotographic copiers, printers, and the like. As a recording medium, an OHP sheet is also exemplified other than the recording sheet P.

The surface of the recording sheet P is preferably smooth in order to further improve smoothness of the image surface after fixing. For example, coating paper obtained by coating a surface of plain paper with a resin or the like, art paper for printing, and the like are preferably used.

The recording sheet P on which the fixing of the color image is completed is discharged toward a discharge part, and a series of the color image forming operations end.

Process Cartridge/Toner Cartridge

A process cartridge according to this exemplary embodiment will be described.

The process cartridge according to this exemplary embodiment is provided with a developing unit that accommodates the electrostatic charge image developer according to this exemplary embodiment and develops an electrostatic charge image formed on a surface of an image holding member with the electrostatic charge image developer as a toner image, and is detachable from an image forming apparatus.

The process cartridge according to this exemplary embodiment is not limited to the above-described configuration, and may be configured to include a developing device, and if necessary, at least one selected from other units such as an image holding member, a charging unit, an electrostatic charge image forming unit, and a transfer unit.

Hereinafter, an example of the process cartridge according to this exemplary embodiment will be shown. However, this process cartridge is not limited thereto. Major parts shown in the drawing will be described, and descriptions of other parts will be omitted.

Figure 2:
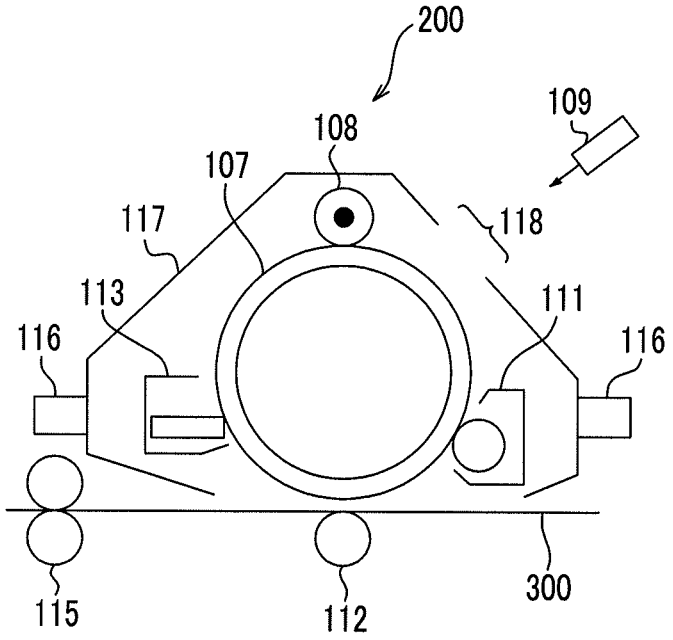
FIG. 2 is a schematic configuration diagram showing an example of a process cartridge according to the exemplary embodiment.

FIG. 2 is a schematic diagram showing a configuration of the process cartridge according to this exemplary embodiment.

A process cartridge 200 shown in FIG. 2 is formed as a cartridge having a configuration in which a photoreceptor 107 (an example of the image holding member), a charging roll 108 (an example of the charging unit), a developing device 111 (an example of the developing unit), and a photoreceptor cleaning device 113 (an example of the cleaning unit), which are provided around the photoreceptor 107, are integrally combined and held by the use of, for example, a housing 117 provided with a mounting rail 116 and an opening 118 for exposure.

In FIG. 2, the reference numeral 109 represents an exposure device (an example of the electrostatic charge image forming unit), the reference numeral 112 represents a transfer device (an example of the transfer unit), the reference numeral 115 represents a fixing device (an example of the fixing unit), and the reference numeral 300 represents a recording sheet (an example of the recording medium).

Next, a toner cartridge according to this exemplary embodiment will be described.

The toner cartridge according to this exemplary embodiment accommodates the toner according to this exemplary embodiment and is detachable from an image forming apparatus. The toner cartridge accommodates a toner for replenishment for being supplied to the developing unit provided in the image forming apparatus.

The image forming apparatus shown in FIG. 1 has such a configuration that the toner cartridges 8Y, 8M, 8C, and 8K are detachable therefrom, and the developing devices 4Y, 4M, 4C, and 4K are connected to the toner cartridges corresponding to the respective developing devices (colors) via toner supply tubes (not shown), respectively. In addition, when the toner accommodated in the toner cartridge runs low, the toner cartridge is replaced.

EXAMPLES

Hereinafter, this exemplary embodiment will be described in detail using examples, but is not limited to these examples. In the following description, unless specifically noted, "parts" and "%" are based on the weight.

Preparation of Styrene-Acrylic Resin Particle Dispersion

Styrene-Acrylic Resin Particle Dispersion (A)

Styrene (manufactured by Wako Pure Chemical Industries, Ltd.): 323 parts by weight n-butyl acrylate (manufactured by Wako Pure Chemical Industries, Ltd.): 77 parts by weight 2-carboxyethyl acrylate (β-CEA manufactured by Rhodia Nicca, Ltd.): 0.2 part by weight Dodecanethiol (manufactured by Wako Pure Chemical Industries, Ltd.): 6 parts by weight A solution obtained by mixing and dissolving the above components is emulsified and dispersed in an aqueous solution obtained by dissolving 6 parts by weight of a nonionic surfactant (NONIPOL 400 manufactured by Sanyo Chemical Industries, Ltd.) and 10 parts by weight of an anionic surfactant (NEOGEN SC manufactured by Dai-Ichi Kogyo Seiyaku Co., Ltd.) in 550 parts by weight of ion exchange water, in a flask, and gently mixed for 10 minutes, and 50 parts by weight of ion exchange water in which 4 parts by weight of ammonium persulfate is dissolved is put thereto. After performing nitrogen substitution, the aqueous solution is heated in an oil bath to be 70° C. while stirring in the flask, and emulsion polymerization is continued for 5 hours. As a result, a resin dispersion in which styrene-acrylic resin particles having the volume average particle diameter D50v of 100 nm, the glass transition temperature Tg of 55° C., and the weight-average molecular weight Mw of 52000 are dispersed, is obtained.

Styrene-Acrylic Resin Particle Dispersion (B)

Styrene-acrylic resin particle dispersion (B) is prepared in the same manner as in the preparation of the styrene-acrylic resin particle dispersion (A), except that the amount of 2-carboxyethyl acrylate (β-CEA) is changed to 0.00036 part by weight.

Styrene-Acrylic Resin Particle Dispersion (C)

Styrene-acrylic resin particle dispersion (C) is prepared in the same manner as in the preparation of the styrene-acrylic resin particle dispersion (A), except that the amount of 2-carboxyethyl acrylate (β-CEA) is changed to 4.02 parts by weight.

Styrene-Acrylic Resin Particle Dispersion (D)

Styrene-acrylic resin particle dispersion (D) is prepared in the same manner as in the preparation of the styrene-acrylic resin particle dispersion (A), except that the amount of dodecanethiol is changed to 44 parts by weight.

Styrene-Acrylic Resin Particle Dispersion (E)

Styrene-acrylic resin particle dispersion (E) is prepared in the same manner as in the preparation of the styrene-acrylic resin particle dispersion (A), except that the amount of dodecanethiol is changed to 1.6 parts by weight.

Styrene-Acrylic Resin Particle Dispersion (F)

Styrene-acrylic resin particle dispersion (F) is prepared in the same manner as in the preparation of the styrene-acrylic resin particle dispersion (A), except that the amount of styrene is changed to 354 parts by weight and the amount of n-butyl acrylate is changed to 46 parts by weight.

Styrene-Acrylic Resin Particle Dispersion (G)

Styrene-acrylic resin particle dispersion (G) is prepared in the same manner as in the preparation of the styrene-acrylic resin particle dispersion (A), except that the amount of styrene is changed to 290 parts by weight and the amount of n-butyl acrylate is changed to 110 parts by weight.

Styrene-Acrylic Resin Particle Dispersion (H)

Styrene-acrylic resin particle dispersion (H) is prepared in the same manner as in the preparation of the styrene-acrylic resin particle dispersion (A), except that 2-carboxyethyl acrylate is changed to acrylic acid.

Content of a polymerization component derived from acrylic acid contained in the styrene-acrylic resin in the obtained styrene-acrylic resin particle dispersion (H) is 0.05% by weight.

Physical properties of Styrene-Acrylic Resin

For the styrene-acrylic resin contained in each styrene-acrylic resin particle dispersion obtained as described above, the content of the polymerization component derived from 2-carboxyethyl acrylate (noted as "content of β-CEA" in Table) and physical properties (weight-average molecular weight (Mw) and glass transition temperature (Tg)) are measured by the method described above.

The results are shown in Table 1.

Preparation of Polyester Resin Particle Dispersion

Amorphous Polyester Resin Particle Dispersion ethylene glycol: 37 parts by weight neopentyl glycol: 65 parts by weight 1,9-nonanediol: 32 parts by weight terephthalic acid: 96 parts by weight The monomers are put into a flask and heated to a temperature of 200° C. over 1 hour, and it is checked that stirring is performed in the reaction system, and then, 1.2 parts of dibutyl tin oxide is put thereto. In addition, the temperature is increased from that temperature to 240° C. over 6 hours while distilling away the generated water, and dehydration condensation reaction is further continued at 240° C. for 4 hours, to obtain a polyester resin (PE) having an acid value of 9.4 mgKOH/g, weight-average molecular weight of 13,000, and glass transition temperature of 62° C.

Next, the polyester resin (PE) is transported to Cavitron CD1010 (manufactured by Eurotec Ltd.) at a rate of 100 parts per minute, in a melted state. Diluted ammonia water having a concentration of 0.37% obtained by diluting reagent aqueous ammonia with ion exchange water is put into an aqueous medium tank prepared separately, and the resultant material is transported to the Cavitron with the polyester resin melted body, at a rate of 0.1 liter per minute, while heating to 120° C. in a heat exchanger. The Cavitron is operated under the conditions of a rotation rate of a rotator of 60 Hz and pressure of 5 kg/cm$^2$, and polyester resin particle dispersion (PES dispersion) in which polyester resin particles having a volume average particle diameter of 160 nm, solid content of 30%, glass transition temperature of 62° C., and weight-average molecular weight Mw of 13,000 are dispersed, is obtained.

Crystalline Polyester Resin Particle Dispersion

Dimethyl sebacate: 52% by mol 1,6-hexanediol: 48% by mol

Dibutyl tin oxide: 0.05% by mol

The above components are mixed in a flask, heated to 220° C. under a reduced-pressure atmosphere, and subjected to dehydration condensation reaction for 6 hours, and the crystalline polyester resin is obtained. A melting temperature of the obtained resin is 68° C. and weight-average molecular weight Mw thereof is 25000.

Next, 80 parts of the crystalline polyester resin and 720 parts of deionized water are put into a stainless steel beaker, and heated to 98° C. in a warm bathtub. When the crystalline polyester resin (A) is melted, stirring is performed at 7000 rpm using a homogenizer (Ultra Turrax T50 manufactured by IKA Japan, K.K.). After that, emulsification and dispersion are performed while adding 1.8 parts of the anionic surfactant (NEOGEN RK; 20%, manufactured by Dai-Ichi Kogyo Seiyaku Co., Ltd.) dropwise, and crystalline polyester resin dispersion (resin particle concentration: 10%) having an average particle diameter of 0.23 μm is obtained.

Preparation of Colorant Particle Dispersion

Preparation of Colorant Particle Dispersion (1)

Carbon black pigment (Regal 330): 70 parts by weight

Nonionic surfactant: 5 parts by weight (NONIPOL 400 manufactured by Sanyo Chemical Industries, Ltd.)

Ion exchange water: 220 parts by weight

The above components are mixed with and dissolved in each other, and are dispersed for 10 minutes using a homogenizer (Ultra Turrax T50 manufactured by IKA Japan, K.K.), and colorant particle dispersion (1) in which colorant (cyan pigment) particles having a volume average particle diameter D50v of 260 nm are dispersed, is prepared.

Preparation of Release Agent Particle Dispersion

Release Agent Particle Dispersion (1)

Paraffin wax: 53 parts by weight (HNP 0190 manufactured by Nippon Seiro Co., Ltd., melting point of 85° C.)

Cationic surfactant: 6 parts by weight (SANISOL B50 manufactured by Kao Corporation)

Ion exchange water: 200 parts by weight

The above components are heated to 95° C., dispersed for 10 minutes using a homogenizer (Ultra Turrax T50 manufactured by IKA Japan, K.K.) in a stainless-steel round flask, and then are subjected to a dispersion treatment using a pressure discharge type homogenizer, and release agent particle dispersion in which the release agent particles having a volume average particle diameter D50v of 550 nm are dispersed, is prepared.

Example 1

Preparation of Toner (1)

Styrene-acrylic resin particle dispersion (A): 37.5 parts by weight

Amorphous polyester resin particle dispersion: 220 parts by weight

Crystalline polyester resin particle dispersion: 80 parts by weight

Colorant particle dispersion (1): 20 parts by weight

Release Agent particle dispersion (1): 30 parts by weight

Cationic surfactant (SANISOL B50 manufactured by Kao Corporation): 1.5 parts by weight The above components are mixed and dispersed in a stainless-steel round flask using a homogenizer (Ultra Turrax T50 manufactured by IKA Japan, K.K.), and heated to 50° C. in a heating oil bath while stirring the inside of the flask. It is kept at 45° C. for 20 minutes. The formation of aggregated particles having a volume average particle diameter of approximately 4.8 μm at that time is confirmed. 60 parts by weight of the Styrene-acrylic resin particle dispersion (A) is additionally gently added to the mixed liquid described above. Then, it is kept for 30 minutes after increasing the temperature of the heating oil bath to 50° C. The formation of aggregated particles having a volume average particle diameter of approximately 5.8 μm is confirmed.

After adding 3 parts by weight of the anionic surfactant (NEOGEN SC manufactured by Dai-Ichi Kogyo Seiyaku Co., Ltd.) to the mixed liquid described above, the stainless-steel flask is sealed, and the mixed liquid is heated to 100° C. while stirring using a magnetic seal, and kept for 4 hours. After cooling, a reaction product is filtrated, sufficiently washed with the ion exchange water, and dried, and thus toner particles (1) having a shape factor of 120.5 and D50v of 6.4 μm are obtained.

The preparing method of the toner particles described above is called an emulsion polymerization aggregation method (EA).

After that, 3.3 parts by weight of hydrophobic silica particles (manufactured by Aerosil Nippon Co., Ltd., RY50) is added to 100 parts by weight of the toner particles (1), as an external additive. Then, the resultant material is mixed at a peripheral speed of 30 m/s for 3 minutes, using a Henschel mixer. Next, the resultant material is sieved with a vibration sieving machine having mesh of 45 μm, and toner (1) is obtained.

Preparation of Carrier

Ferrite particles (volume average particle diameter of 50 μm): 100 parts by weight Toluene: 100 parts by weight 15 parts by weight Styrene-methyl methacrylate copolymer (component molar ratio: 90/10):2 parts by weight Carbon black (R330 manufactured by Cabot Corporation): 0.25 part by weight First, a coating solution is prepared by stirring and dispersing the above components excluding the ferrite particles with a stirrer for 10 minutes. Then, this coating solution and the ferrite particles are put into a vacuum deaeration kneader and stirred at 60° C. for 25 minutes, then the pressure is reduced for deaeration while heating, and drying is performed to prepare a carrier. Regarding this carrier, a shape factor is 120, a true specific gravity is 4.4, saturated magnetization is 63 emu/g, and a volume resistivity value in an applied electric field of 1000 V/cm is 1000 Ω·cm.

Preparation of Developer (1)

8 parts by weight of the toner (1) and 92 parts by weight of the carrier prepared as described above are put into a V-blender, stirred for 20 minutes, and sieved with mesh of 105 μm, and thereby a developer (1) is prepared.

Examples 2 to 11

Toner (2) to (11) are prepared in the same manner as in Example 1, except for using the styrene-acrylic resin particle dispersion (noted as "SAc dispersion" in Table) according to Table 1, and changing the used amount thereof or the used amount of the crystalline polyester resin dispersion so as to be "content of SAc resin" and "content of crystalline PES resin" disclosed in Table 1.

Developers (2) to (11) are prepared in the same manner as in Example 1, except for using the obtained toner (2) to (11).

Comparative Examples 1 and 2

Toners (C1) and (C2) are prepared in the same manner as in Example 1, except for changing the types of the styrene-acrylic resin particle dispersion (noted as "SAc dispersion" in Table) or not using the styrene-acrylic resin particle dispersion according to Table 1.

Developers (C1) and (C2) are prepared in the same manner as in Example 1, except for using the obtained toners (C1) and (C2).

Comparative Example 3

Toner (C3) is prepared in the same manner as in the preparation of toner particles (1) in Example 1, except for using 300 parts by weight of the amorphous polyester resin particle dispersion without using the crystalline polyester resin particle dispersion.

A developer (C3) is prepared in the same manner as in Example 1, except for using the obtained toner (C3).

Comparative Example 4

First, 160 parts of the crystalline polyester resin, 80 parts of carbon black pigment (Regal 330), and 112 parts of paraffin wax (HNP 0190 manufactured by Nippon Seiro Co., Ltd.) are kneaded in an extruder at 150° C., and a kneaded material is obtained.

Styrene: 487 parts

Butyl acrylate: 137 parts

Kneaded material described above: 176 parts

Cationic surfactant (SANISOL B50 manufactured by Kao Corporation): 0.2 part by weight Toluene (manufactured by Wako Pure Chemical Industries, Ltd.): 400 parts Ceramic beads of 15 mm are input to each component, dispersed for 2 hours using an attritor (Mitsui Miike Engineering Co, Ltd.), and thereby a composition is obtained. 800 parts of the ion exchange water and 3.5 parts of tricalcium phosphate are added into a container including a high-speed stirring device TK-homogenizer (Tokushu Kika Kogyo Co., Ltd.), a rotation rate is adjusted to 12000 rotation/min, and a temperature is increased to 80° C., to obtain a dispersion medium system. 7.5 parts of t-butylperoxy pivalate is added to the composition described above, and this is input to the dispersion medium system. While performing nitrogen substitution, the rotation rate of 12000 rotation/min is maintained with the high-speed stirring device and a granulation step is performed for 5 minutes. After that, a stirrer is changed from the high-speed stirring device to a propeller stirring blade, the resultant material is stirred at a rotation rate of 150 rotation/min, held at 80° C., and subjected to polymerization for 8 hours. After polymerization ends, the obtained dispersion of the particles is cooled to 30° C. at a rate of 0.5° C./min.

Then, 0.3 mol/L of hydrochloric acid is added dropwise at a dropping rate of 1.0 part/min, pH of the dispersion is set to 1.5, and then stirring is continued for 2 hours. After that, under stirring, 1.0 mol/L of aqueous sodium hydroxide solution is added dropwise so that pH of the dispersion becomes 7.5. Then, the dispersion is held at 66° C. and further stirred for 1 hour. The dispersion is cooled to 20° C. and diluted hydrochloric acid is added thereto until pH becomes 1.5. Further, after sufficiently washing the dispersion with the ion exchange water, filtrating, drying, and classification are performed, and toner particles (C4) are obtained.

Toner (C4) and a developer (C4) containing the toner (C4) are prepared in the same manner as in Example 1, except for using the obtained toner particles (C4).

Evaluation

The following evaluation is performed using the developer (toner) obtained in each Example. The results are shown in Table 1.

Evaluation of Transfer Unevenness in Half-Tone Image

A modifier of a DocuCentre Color 400CP (manufactured by Fuji Xerox Co., Ltd.) (modified so that an unfixed image may be output even when a fixing machine is detached) is prepared as a evaluation machine, and C2 paper (manufactured by Fuji Xerox Co., Ltd.) is prepared as a sheet. In the fixing of an image, an external fixing device (fixing roll surface is PFA coated, oil-less) is used, and a nip width is set to 6.5 mm, a fixing rate is set to 220 mm/sec, and a fixing temperature is set to 160° C.

In the evaluation machine, a toner amount is adjusted to 0.5 $g/m^2$, and a half-tone image is formed, and this operation is repeated for 1000 sheets. After that, images in the first and thousandth sheet are compared to each other, and a difference in transfer unevenness is visually evaluated.

Evaluation criteria of the transfer unevenness are as follows.

G1: No difference is confirmed in images.

G2: Slight unevenness is confirmed in thousandth image.

G3: Unevenness is confirmed in thousandth image, but there is no practical problem.

G4: Unevenness is clearly confirmed in thousandth image.

G1 to G3 are allowable in practical use.

Evaluation of Low Temperature Fixability

Using the obtained developer in each Example and using a modifier of a DocuCentre-IV C4300, manufactured by Fuji Xerox Co., Ltd. (modified so that the fixing is performed by an external fixing machine with a variable fixing temperature), under the environment of 25° C. and 55% RH, a toner amount is adjusted to 9.8 g/m$^2$ and a solid toner image is formed on paper (JD paper), manufactured by Fuji Xerox Co., Ltd.

After the toner image is formed, the toner image is fixed at a fixing rate of 150 mm/sec under a Nip of 6.5 mm using a Free Belt Nip Fuser-type external fixing machine. When fixing the toner image, the fixing temperature is changed by 5° C., and the low temperature fixability is evaluated from a temperature at which offset on the low temperature side occurs.

Evaluation criteria of the low temperature fixability are as follows.

G1: A temperature of generation of offset on the low temperature side is equal to or lower than 140° C.

G2: A temperature of generation of offset on the low temperature side is higher than 140° C. and equal to or lower than 150° C.

G3: A temperature of generation of offset on the low temperature side is higher than 150° C. and equal to or lower than 170° C.

G4: A temperature of generation of offset on the low temperature side is higher than 170° C.

Generation and non-generation of offset on the low temperature side are determined depending on presence or absence of the practical problem, and G1 to G3 are allowable ranges.

The foregoing description of the exemplary embodiments of the present invention has been provided for the purposes of illustration and description. It is not intended to be exhaustive or to limit the invention to the precise forms disclosed. Obviously, many modifications and variations will be apparent to practitioners skilled in the art. The embodiments were chosen and described in order to best explain the principles of the invention and its practical applications, thereby enabling others skilled in the art to understand the invention for various embodiments and with the various modifications as are suited to the particular use contemplated. It is intended that the scope of the invention be defined by the following claims and their equivalents.

What is claimed is:

1. An electrostatic charge image developing toner comprising:

toner particles containing, an amorphous polyester resin (a1), a crystalline polyester resin (a2), and a styrene-acrylic resin (b) containing 2-carboxyethyl acrylate as a polymerization component, wherein a weight ratio (a1):(a2):(b) of the amorphous polyester resin (a1), the crystalline polyester resin (a2), and the styrene-acrylic resin (b) is in a range of 2 to 9:0.2 to 3:0.1 to 4.

2. The electrostatic charge image developing toner according to claim 1, wherein a content of the styrene-acrylic resin (b) in the toner particles is from 1% by weight to 40% by weight with respect to the weight of the toner particles.

3. The electrostatic charge image developing toner according to claim 1, wherein a content of a polymerization component derived from 2-carboxyethyl acrylate in the styrene-acrylic resin (b) is from 0.001% by weight to 1.000% by weight with respect to the weight of the entire styrene-acrylic resin.

TABLE 1

| | | SAc dispersion | | | | | | Content of | Preparing | Evaluation | |
|---|---|---|---|---|---|---|---|---|---|---|---|
| | | | SAc resin | | | | Content of | crystalline | method of | | Low |
| | Toner No. | Dispersion No. | Content of β-CEA (% by weight) | Mw | Tg (° C.) | SAc resin (% by weight) | PES resin (% by weight) | toner particles | Transfer unevenness | temperature fixability |
| Example 1 | (1) | A | 0.05 | 52000 | 55 | 15 | 8 | EA | G1 | G1 |
| Example 2 | (2) | B | 0.00009 | 52000 | 55 | 15 | 8 | EA | G1 | G2 |
| Example 3 | (3) | C | 1.005 | 52000 | 55 | 15 | 8 | EA | G2 | G1 |
| Example 4 | (4) | A | 0.05 | 52000 | 55 | 41 | 8 | EA | G1 | G2 |
| Example 5 | (5) | A | 0.05 | 52000 | 55 | 0.9 | 8 | EA | G2 | G1 |
| Example 6 | (6) | D | 0.05 | 4700 | 55 | 15 | 8 | EA | G1 | G2 |
| Example 7 | (7) | E | 0.05 | 250000 | 55 | 15 | 8 | EA | G2 | G1 |
| Example 8 | (8) | F | 0.05 | 52000 | 71 | 15 | 8 | EA | G1 | G2 |
| Example 9 | (9) | G | 0.05 | 52000 | 39 | 15 | 8 | EA | G2 | G1 |
| Example 10 | (10) | A | 0.05 | 52000 | 55 | 15 | 1.5 | EA | G1 | G3 |
| Example 11 | (11) | A | 0.05 | 52000 | 55 | 15 | 31 | EA | G2 | G1 |
| Com. Ex. 1 | (C1) | H | — | 52000 | 55 | 15 | 8 | EA | G4 | G3 |
| Com. Ex. 2 | (C2) | None | — | — | — | — | 8 | EA | G4 | G1 |
| Com. Ex. 3 | (C3) | A | 0.05 | 52000 | 55 | 15 | 0 | EA | G2 | G4 |
| Com. Ex. 4 | (C4) | — | — | 52000 | 55 | 78 | 10 | Suspension polymerization and capsule | G4 | G4 |

From the results, with the toner of Examples, it is found that it is possible to suppress the generation of transfer unevenness in a half-tone image, compared to Comparative Examples.

In addition, it is also found that the toner of Examples have excellent low temperature fixability.

4. The electrostatic charge image developing toner according to claim 1, wherein a weight-average molecular weight of the styrene-acrylic resin (b) is from 5,000 to 200,000.

5. The electrostatic charge image developing toner according to claim 1, wherein a glass transition temperature of the styrene-acrylic resin (b) is from 40° C. to 70° C.

6. The electrostatic charge image developing toner according to claim 1, wherein a content of the crystalline polyester resin (a2) in the toner particles is from 2% by weight to 30% by weight with respect to the weight of the toner particles.

7. An electrostatic charge image developer comprising the electrostatic charge image developing toner according to claim 1.

8. A process cartridge comprising:

a developing unit that contains the electrostatic charge image developer according to claim 7, and develops an electrostatic charge image formed on a surface of an image holding member as a toner image with the electrostatic charge image developer, wherein the process cartridge is detachable from an image forming apparatus.

9. A toner cartridge that contains the electrostatic charge image developing toner according to claim 1, and is detachable from an image forming apparatus.

* * * * *